United States Patent [19]

Leboutet et al.

[11] 4,243,916

[45] Jan. 6, 1981

[54] MAGNETIC MIRROR FOR BEAMS OF CHARGED PARTICLES ACCELERATED IN AN ACCELERATOR

[75] Inventors: Hubert Leboutet; Dominique Tronc, both of Buc, France

[73] Assignee: C.G.R.MeV, Buc, France

[21] Appl. No.: 30,937

[22] Filed: Apr. 17, 1979

[30] Foreign Application Priority Data

Apr. 21, 1978 [FR] France ..... 78 11856

[51] Int. Cl.[3] ..... H01T 7/24; H05B 31/26

[52] U.S. Cl. ..... 315/111.8; 335/210; 313/361; 328/230

[58] Field of Search ..... 313/329, 361; 328/230, 328/233; 315/111.8; 335/209, 210

[56] References Cited

U.S. PATENT DOCUMENTS 3,967,225 6/1976 Heighway ..... 313/361

4,004,181 1/1977 Kervizic et al. ..... 315/5.41

*Primary Examiner*—Alfred E. Smith

*Assistant Examiner*—Thomas P. O'Hare

*Attorney, Agent, or Firm*—Cushman, Darby & Cushman

[57] ABSTRACT

Magnetic mirror enabling a beam F of charged particles to be reflected along its incident path whatever the value W of the momentum of said particles. This magnetic mirror includes a first magnetic deflector having polepieces of circular shape, a second and a third magnetic deflector provided respectively with pairs of polepieces arranged symmetrically with regard to an axis XX coinciding with the mean incident path of the beam F, the entry and exit face of these polepieces being determined in such a way that the beam F emerging from the second magnetic deflector is perpendicular to the symmetry axis of the mirror and that the vertical divergence of the beam is compensated.

11 Claims, 8 Drawing Figures

MAGNETIC MIRROR FOR BEAMS OF CHARGED PARTICLES ACCELERATED IN AN ACCELERATOR

BACKGROUND OF THE INVENTION

The present invention relates to a magnetic mirror for beams of charged particles, this magnetic mirror, which is designed to be used in association with an accelerator of charged particles (electrons for example) having variable energy, enabling the beam of charged particles to be passed twice through the accelerating structure.

Accelerators using a magnetic mirror are early described by the U.S. Pat. No. 4,004,181 as well as in the publications of G. Hortig and A. A. Kolomenski, and designed so as to ensure the isochronism of the reflected and incident beams. This results in a magnetic mirror relatively complex, but the isochronism of the outgoing and return beams enables the accelerated beam issued from this accelerator to be a beam of very fine spectrum, since the beam is always accelerated on the peak of the electromagnetic wave generated in the accelerating cavities.

However, it appears that, if a charged particle accelerator is caused to function in such a way that the beam is accelerated on the outgoing and return path respectively on the two edges located on either side of the peak of the accelerating electromagnetic wave, this makes it possible to alleviate the demand for perfect isochronism of the outward and return beams, thus no longer requiring mechanical displacement of the mirror in relation to the accelerator, which is generally necessary when the energy of the beam of particles is modified. This mechanical displacement is then replaced by the phase shifting provided by the magnetic mirror, to which the invention relates, as a function of the energy of said particles.

SUMMARY OF THE INVENTION

It is an object of the invention to provide a magnetic mirror designed to reflect a beam F of charged particles along its mean incident path having an axis X—X, said mirror comprising at least a first, a second and a third magnetic deflector, said first magnetic deflector being provided with two polepieces having the shape of circles with a radius R and delimiting a circular air-gap having a centre O located along the axis X—X and in which a magnetic field $H_1$ of a predetermined value is set up, said second and third magnetic deflector being provided respectively with a pair of polepieces, the pair of polepieces of the second deflector and the pair of polepieces of the third deflector being identical and delimiting air-gaps symmetrically arranged on either side of said axis X—X and, in which is set up a magnetic field H whose direction is opposed to that of magnetic field $H_1$; said air-gaps of the second and third magnetic deflector respectively presenting the beam F an entry face and an exit face, the entry face of the second magnetic deflector and the exit face of the third magnetic deflector being arranged about the circular air-gap of the first deflector, the exit face of the second magnetic deflector being defined in such a way that the different paths of the particles, the length of which is depending on the momentum of said particles, emerge from said exit face of said second magnetic deflector normal to said axis X—X.

BRIEF DESCRIPTION OF THE DRAWINGS

For the better understanding of the invention and to show how the same may be carried into effect, reference will be made to the drawings accompanying the ensuing description in which.

DETAILED DESCRIPTION

Figure 1:
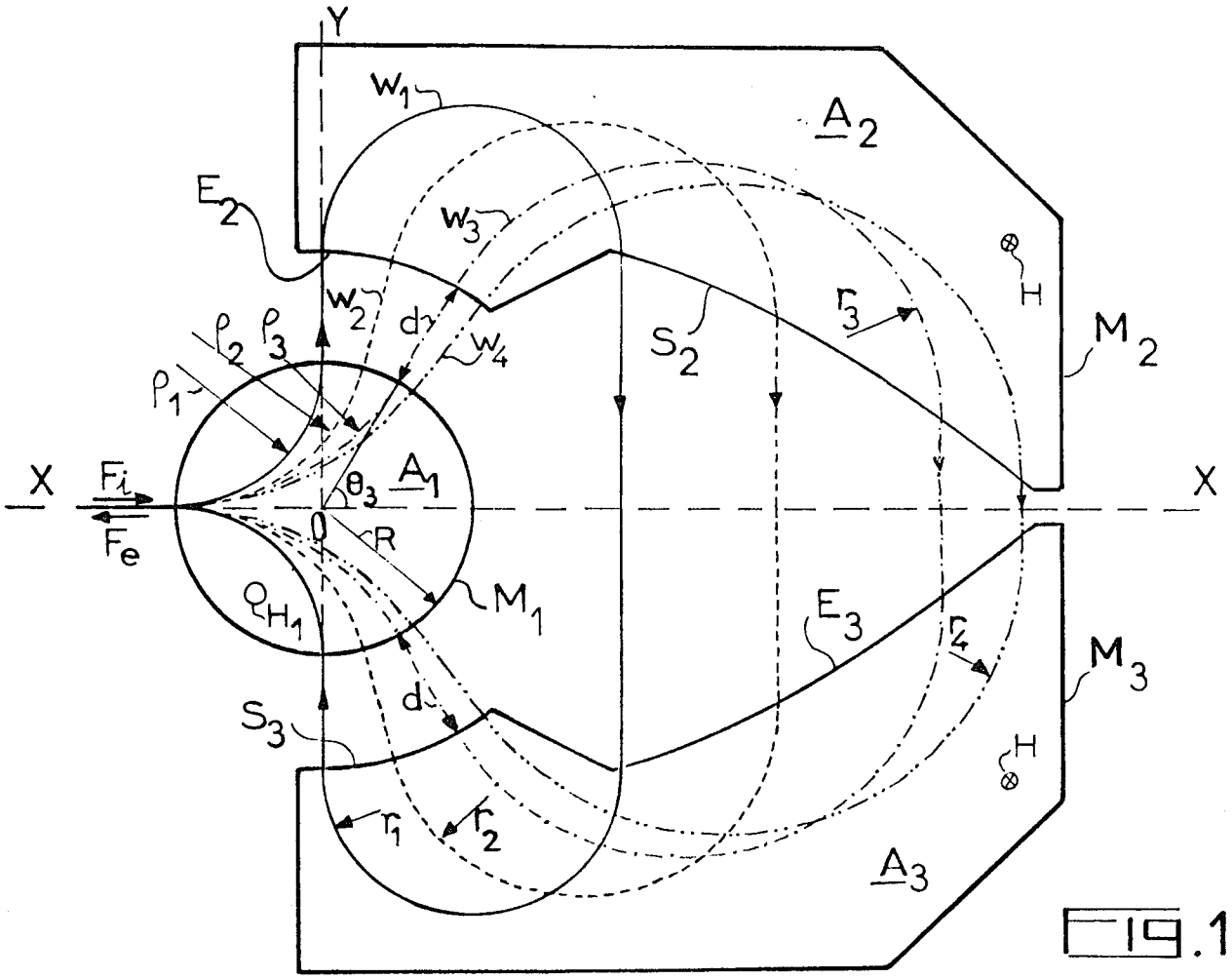
FIG. 1 is a diagram representing an example of a magnetic mirror according to the invention.

The magnetic mirror according to the invention, diagrammatically illustrated in FIG. 1, comprises three magnetic deflectors which are three electromagnets, $M_1$, $M_2$ and $M_3$ provided respectively with pairs of polepieces $A_1$, $B_1$; $A_2$, $B_2$; $A_3$, $B_3$. The plane of the figure corresponds to the median plane of the air-gaps delimited by the polepieces $A_1$, $B_1$; $A_2$, $B_2$; $A_3$, $B_3$. Only polepieces $A_1$, $A_2$ and $A_3$ are visible in FIG. 1. The polepieces $A_1$, $B_1$ are constituted by circular plates having a radius R between which a magnetic field $H_1$ of a determined value is set up. The centre O of the air-gap delimited by the polepieces $A_1$, $B_1$ is located on an axis XX, which is the axis of symmetry of the mirror.

The pairs of polepieces $A_2$, $B_2$ and $A_3$, $B_3$ which are arranged symmetrically with regard to the axis XX and present respectively faces $E_2$, $S_2$ and $E_3$, $S_3$ delimit air-gaps in which equal magnetic fields H are set up. The faces $E_2$ and $S_3$ are identical and concentric to the circular polepieces of electromagnet $M_1$. The faces $E_2$, $S_3$, on one hand, and faces $S_2$, $E_3$, on the other hand, are symmetrical, two by two, with regard to the axis XX and determined in such a way that, in operation, the incident beam F (an electron beam for example), when penetrating the air-gap of electromagnet $M_1$ radially in relation to the circular polepieces $A_1$, $B_1$, is deflected by an angle $\theta$, said angle $\theta$ being a function of the energy of the electrons and of the magnetic field $H_1$ supplied by the electromagnet $M_1$. The beam F emerging from the polepieces $A_1$, $B_1$ then passes in succession through electromagnets $M_2$ and $M_3$ in which it is deflected by an angle of $-2([\pi/2]+\theta)$. The beam $F_e$ that emerges from face $S_3$ of electromagnet $M_3$ then once again penetrates electromagnet $M_1$ and is deflected by an angle $\theta$ in such a way that the path of the beam $F_e$, emerging from polepieces $A_1$, $B_1$, coincides with that of the incident beam $F_i$.

In order to achieve this result, the faces $E_2$, $S_2$, and $E_3$, $S_3$ of electromagnets $M_2$ and $M_3$ are defined herebelow according to two orthogonal axes OX and OY, with OX coinciding with the mean incident path XX of beam F (which is also the axis of symmetry XX of the mirror), O being the centre of the air-gap delimited by circular polepieces $A_1$, $B_1$. If R is the radius of the circular polepieces of electromagnet $M_1$, if $\rho=\rho_1, \rho_2, \rho_3 \ldots$ is the radii of curvature of the particles in said electromagnet $M_1$, the values of $\rho_1$, $\rho_2$, $\rho_3$ being a function of the momentum W of the particles and of the magnetic field $H_1$ set up in the air-gap of polepieces $A_1$, $B_1$, and $\theta=\theta_1, \theta_2, \theta_3 \ldots$ the angle of deflection of the paths in the electromagnet $M_1$, $\theta$ being a function of W and $H_1$, $\rho$ is related to $\theta$ as follows:

$$\rho = \frac{R \sin \theta}{1 - \cos \theta} \quad (1)$$

The entry face $E_2$ of polepieces $A_2$, $B_2$ of electromagnet $M_2$ is defined, along the axes OX, OY, by the parametric equations:

$$E_2 \begin{cases} X_{E2} = (R + d) \cos \theta & (2) \\ Y_{E2} = (R + d) \sin \theta & (3) \end{cases}$$

d being the distance travelled by the particles in the spaces comprised between the electromagnets $M_1$, $M_2$ and $M_3$, $M_1$.

The face $S_2$ (exit face of the polepieces $A_2$, $B_2$) is defined in such a way that the paths of the particles emerging from said face $S_2$ are normal to the axis of symmetry XX of the mirror according to the invention. This face $S_2$ is defined, along the axes OX, OY, by the parametric equations:

$$S_2 \begin{cases} X_{S2} = (R + d) \cos \theta + r \sin \theta + r & (4) \\ Y_{S2} = (R + d) \sin \theta - r \cos \theta & (5) \end{cases}$$

the radii of curvature $r=r_1, r_2, r_3 \ldots$ of the particle paths in the electromagnets $M_2$ and $M_3$ being a function of the momentum $W=W_1, W_2, W_3$ of the particles and of the magnetic field H set up in this air-gap. In the example shown in FIG. 1, the magnetic field H is equal to $H_1$ and in the opposite direction. This being the case, the radii of curvature $\rho_1, \rho_2, \rho_3$ are equal respectively to $r_1, r_2, r_3 \ldots$.

Faces $E_3$ and $S_3$ of the polepieces $A_3$, $B_3$ of the electromagnet $M_3$ are symmetrical respectively to the faces $S_2$ and $E_2$, in relation to the axis XX and are thus defined by the parametric equations:

$$E_3 \begin{cases} X_{E3} = (R + d) \cos \theta + r \sin \theta + r & (6) \\ Y_{E3} = -(R + d) \sin \theta + r \cos \theta & (7) \end{cases}$$

$$S_3 \begin{cases} X_{S3} = (R + d) \cos \theta \\ Y_{S3} = -(R + d) \sin \theta \end{cases}$$

the magnetic field set up in the air-gap of the polepieces $A_3$, $B_3$ being equal to the magnetic field H set up in the air-gap of the polepieces $A_3$, $B_3$. Those particles with the same energy have paths with the same radius of curvature r in electromagnets $M_2$ and $M_3$.

In the embodiment shown in FIG. 1, the profile of exit face $S_2$ has been defined by taking a constant value for d, a magnetic field $H_1$ equal to H and consequently $\rho=r$.

Relations (6) and (7) become with the relationship (1):

$$S_2 \begin{cases} X_{S2} = (R + d)\cos \theta + \dfrac{R \sin \theta}{1 - \cos \theta}(1 + \sin \theta) & (10) \\ Y_{S2} = (R + d) \sin \theta + \dfrac{R \sin \theta \cos \theta}{1 - \cos \theta} & (11) \end{cases}$$

It is pointed out that the angle $\theta$ must satisfy to the inequality:

$$O < \cos \theta < \frac{R + d}{2R + d}$$

this inequality establishing that the centres of curvature of the particle paths in the electromagnets $M_2$ and $M_3$ are out of the axis xx and respectively between this axis xx and the electromagnet $M_2$ or $M_3$ considered.

Figure 2:
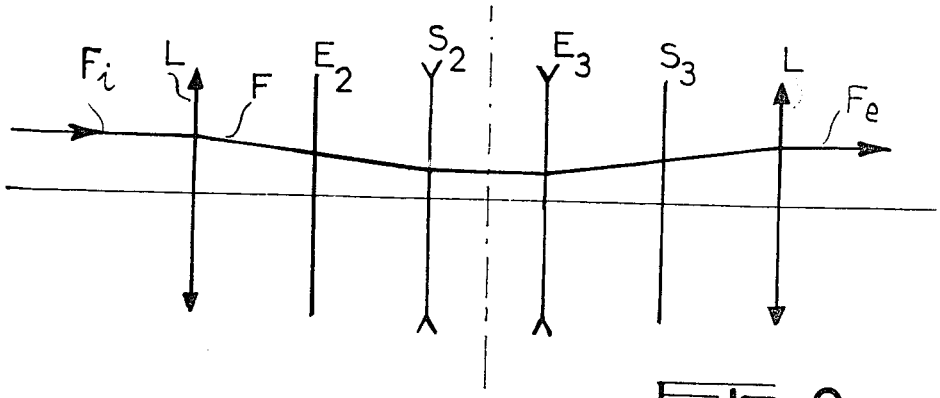
FIG. 2 shows the assembly of magnetic lenses formed by a mirror according to the invention associated with a convergent lens placed before the mirror.
Figure 3:
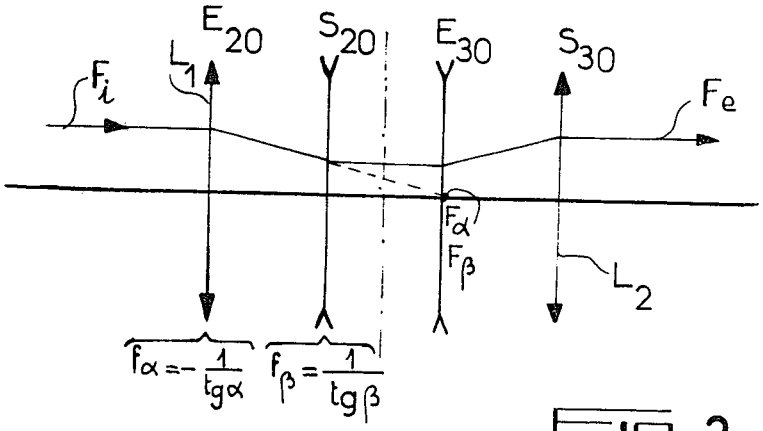
FIG. 3 shows the effect of the vertical focusing of the beam of particles obtained by inclining the entry face of the second electromagnet.

Moreover, it should be noted that said exit face $S_2$ constitutes a divergent magnetic lense in the vertical plane for the emerging beam. In order to compensate for this divergent effect, it is possible to place before the electromagnet $M_1$ of the mirror a correcting convergent magnetic lense L (convergence in the vertical plane so as to obtain a beam as shown in FIG. 2), or to incline the entry face $E_2$ of the electromagnet $M_2$ (as well as the exit face $S_3$ of electromagnet $M_3$) in such a way that the paths of the particles are not normal to said faces $E_2$ and $S_3$ and are subjected to a convergence effect in the vertical plane, as illustrated in FIG. 3.

Figure 4:
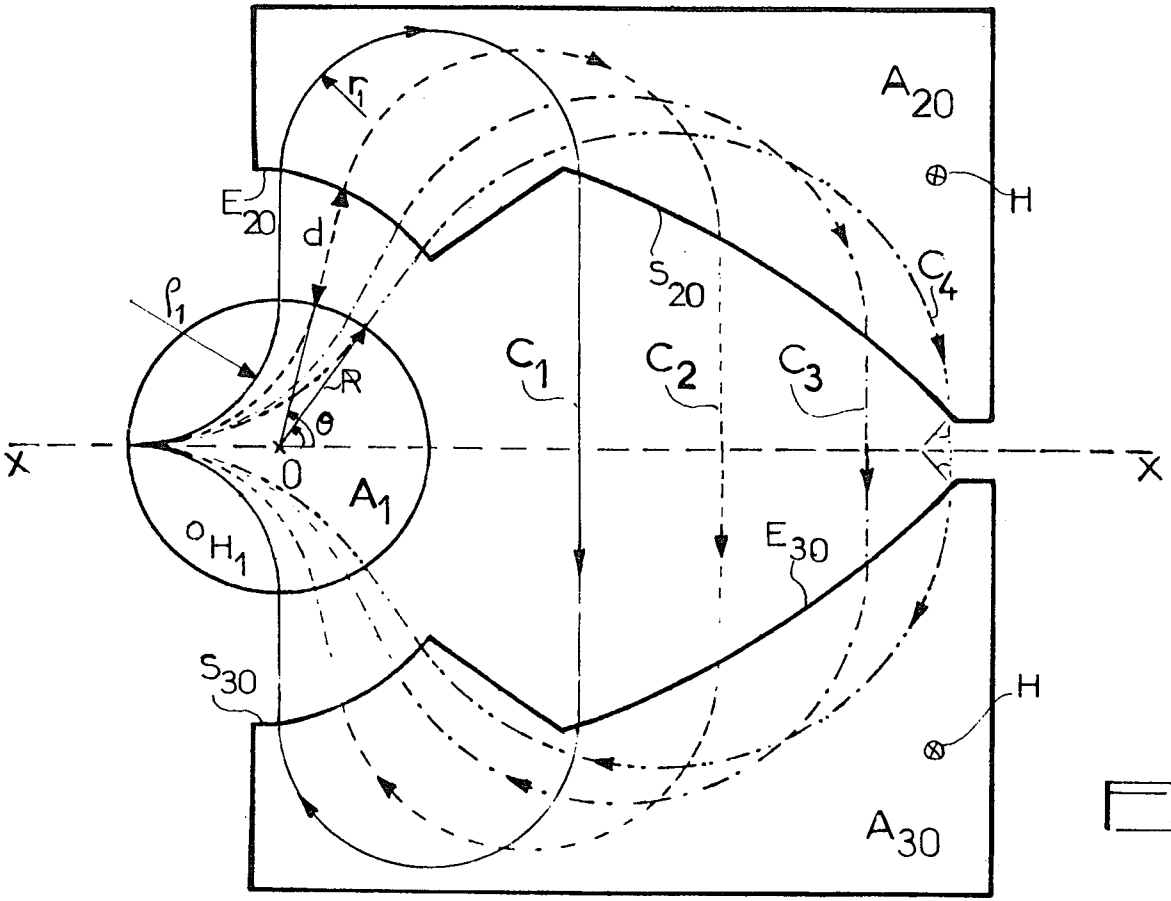
FIG. 4 represents another embodiment of a mirror according to the invention.

FIG. 4 shows an embodiment of a magnetic mirror corresponding to this case. The electromagnets $M_2$ and $M_3$ are provided respectively with polepieces $A_{20}$, $B_{20}$ and $A_{30}$, $B_{30}$, having entry faces $E_{20}$, $E_{30}$ and exit faces $S_{20}$ and $S_{30}$. The faces $E_{20}$ and $S_{30}$ correspond to convergent lenses $L_1$, while the faces $S_{20}$ and $E_{30}$ correspond to divergent lenses $L_2$. The convergence and divergence effects will be compensated if the angles $\alpha$ formed by the paths and the verticals to faces $E_{20}$ (and $S_{30}$)—FIGS. 4 and 5—and the angles $\beta$ formed by the paths and the verticals to faces $S_{20}$ (and $E_{30}$) are related as follows:

$$\left| \frac{1}{tg\alpha} \right| = \frac{1}{tg\beta} \theta + \pi/2 \quad (12)$$

The angles $\alpha$ and $\beta$ being a function of the angle $\theta$, hence of the energy of the particles and of the magnetic fields $H_1$ and H set up in the air-gaps of electromagnets $M_1$ and $M_2$, $M_3$.

Figure 5:
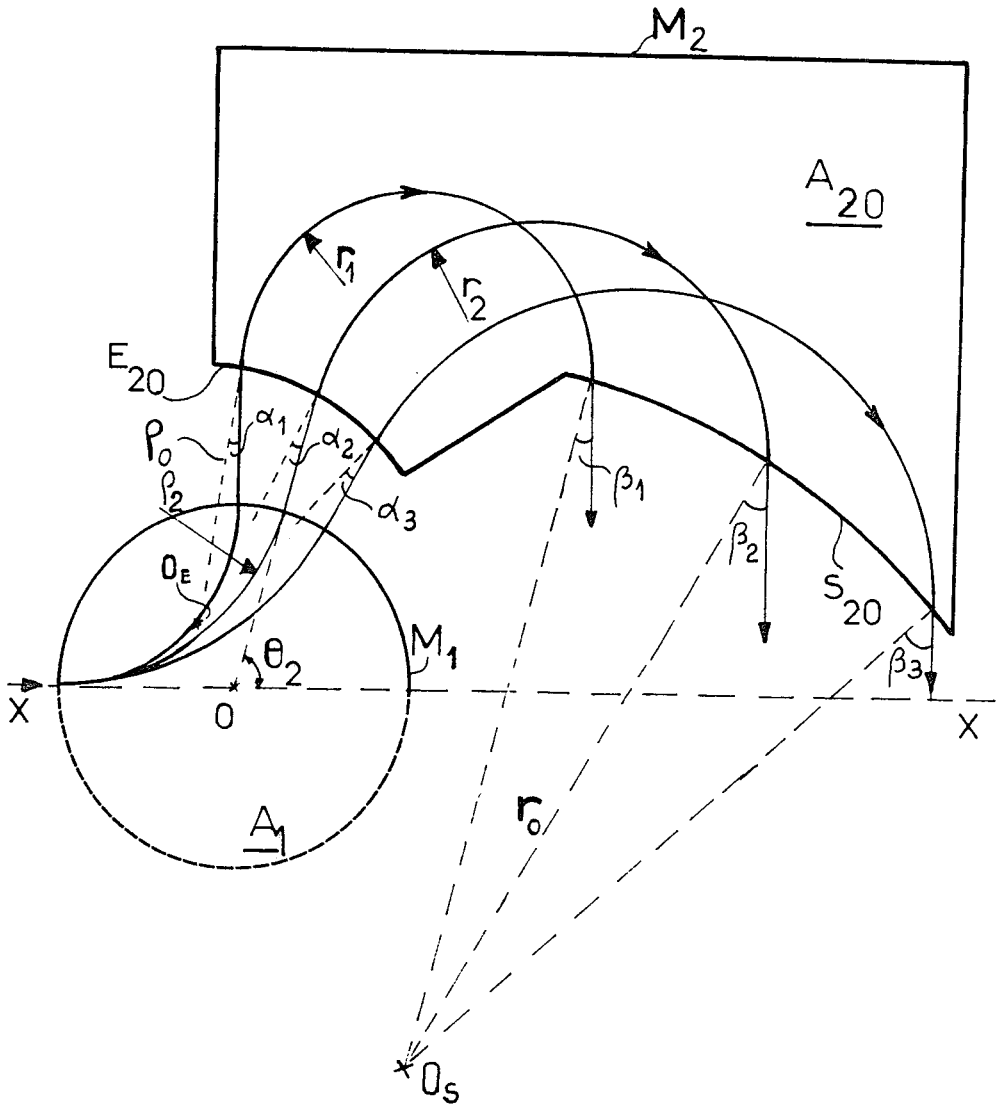
FIG. 5 shows a detail of FIG. 4.

In the embodiment of the magnetic mirror shown in FIG. 4, the electromagnets $M_2$ and $M_3$ are provided respectively with polepieces $A_{20}$, $B_{20}$ and $A_{30}$, $B_{30}$ (only the polepieces $A_{20}$ and $A_{30}$ are shown in FIG. 4). The entry faces $E_{20}$, $E_{30}$ and the exit faces $S_{20}$, $S_{30}$ of the polepieces $A_{20}$ and $A_{30}$ are defined in such a way that the relationships (2) to (9) and (12) are verified. The paths $C_1$ to $C_4$ illustrated in FIG. 4 correspond to electrons accelerated with different momentum. FIG. 5 shows this preferred example of embodiment in greater detail. The paths $C_1$, $C_2$, $C_3$ correspond to electrons with momentum $W_1$, $W_2$, $W_3$ such that, for a magnetic field $H_1$ set up in the air-gap of electromagnet $M_1$, the electrons are deflected in said air-gap by an angle $\theta_1$, $\theta_2$, $\theta_3$ respectively, said angles being substantially equal to 90°, 75°, 60°. The corresponding radii of curvature are $\rho_1, \rho_2, \rho_3$. The magnetic fields H set up in the air-gaps of electromagnets $M_2$ and $M_3$ are equal, in absolute value, to the magnetic field $H_1$ set up in the air-gap of electromagnet $M_1$, but their direction is opposite to that of the latter. The radii of curvature of the paths are $r_1=\rho_1$, $r_2=\rho_2$, $r_3=\rho_3$. The distance d between mirrors $M_1$, $M_2$ and $M_1$, $M_3$ is a function of $\theta$. In the example shown in FIG. 3, d is related to $\rho$ and to $\theta$ as follows:

$$d = 2\rho \cot g\theta \quad (13)$$

and angles $\alpha_1$, $\alpha_2$, $\alpha_3$ are related to the angles $\beta_1$, $\beta_2$, $\beta_3$ as follows:

$$\frac{1}{tg\alpha_m} = \frac{1}{tg\beta_m} + \theta\ \pi/2 \quad (14)$$

The entry face $E_{20}$, which is off-centered in relation to the circular polepiece $A_1$, is shaped to form the arc of a circle having a centre $O_E$ and a radius of curvature $\rho_0$ substantially equal to $\rho_2$.

The exit face $S_{20}$ is substantially the arc of a circle with a centre $O_S$ and a radius of curvature $r_o \simeq 3\rho_2$.

In operating, the particles with momentum $W = W_1$, $W_2$, $W_3$ . . . penetrating inside electromagnet $M_1$ will cross the magnetic mirror along paths $C_1$, $C_2$, $C_3$ . . . and will be reflected along the axis XX with a degree of longitudinal distribution dependent upon the momentum of said particles.

Figure 6:
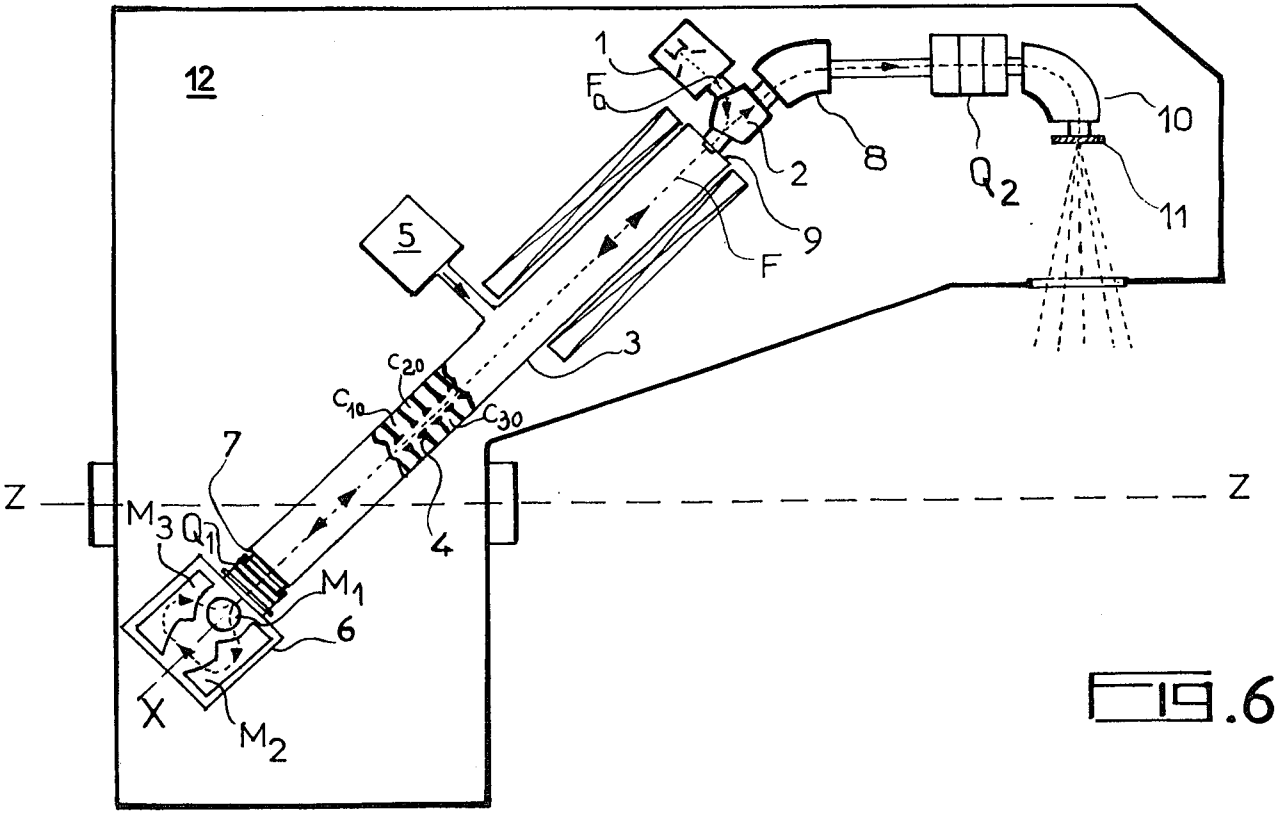
FIG. 6 shows a linear accelerator associated with a mirror according to the invention.

Such a magnetic mirror according to the invention can be associated advantageously with a linear accelerator for charged particles as shown in FIG. 6.

Figure 7:
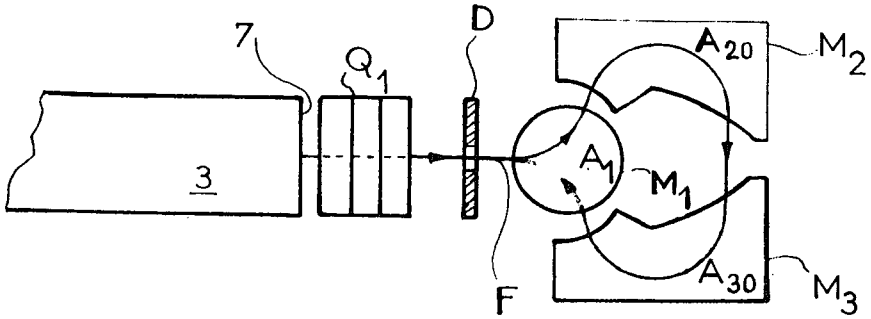
FIGS. 7 and 8 show details of FIG. 6.
Figure 8:
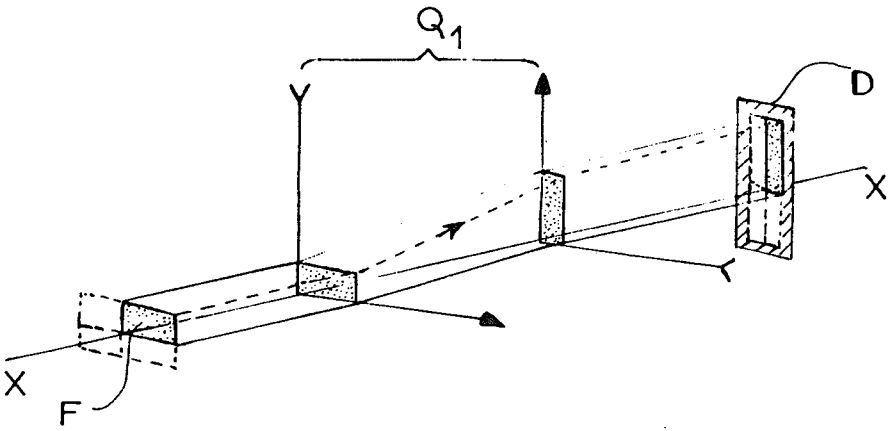

The accelerator device shown in FIG. 6 includes a source 1 of particles (an electron gun, for example), a magnetic deflector 2 designed to deflect the initial beam $F_O$ by an angle a, a linear accelerator 3 comprising an accelerating structure 4, a stationary wave structure for example, constituted by a plurality of microwave resonant cavities $c_{10}$, $c_{20}$, $c_{30}$, means for injecting a microwave signal into these cavities $c_{10}$, $c_{20}$ . . . , said microwave signal being furnished by microwave generator (a magnetron 5, for example), and a magnetic mirror 6 according to the invention. A system of magnetic lenses $Q_1$ and a diaphragm D are placed between the magnetic mirror 6 and the end 7 of the accelerator 3 (FIG. 7) to ensure that the particle beam has a suitable cross-section before and after passing through mirror 6. Beyond the magnetic deflection system 2 are placed, in succession, a second magnetic deflection system 8, a system of quadripolar magnetic lenses $Q_2$, and a third magnetic deflection system 10, the assembly formed by the lens system $Q_2$ and deflection systems 8 and 10 defining a system for obtaining the stigmatic and achromatic deflection of the particle beam F.

In operation, the initial beam $F_o$ from the source 1 of particle placed normal to the axis XX of the accelerator is deflected by the deflector 2 in such a way as to be able to penetrate the accelerating structure 4 of accelerator 3. The accelerated beam $F_i$ emerging from end 7 of accelerator 3 penetrates magnetic mirror 6, after passing through the lense system $Q_1$ and diaphragm D, and then returns towards accelerator 3 to be accelerated once again. The accelerated particles issuing from end 9 of accelerator 3 pass through magnetic deflector 2 in which they are only slightly deflected and then enter the lens system $Q_2$ before being directed towards the target 11 by deflector 10.

The whole of such an accelerator system can easily be housed in the mobile arm 12 of a radiotherapy apparatus as shown in FIG. 6. In order to obtain a suitable beam of particules with a given momentum W, which can vary between two given values, the phase of the H.F. accelerating wave should be adjusted in such a way that the groups of outgoing and returning electrons are suitably distributed on either side of the peak of the microwave signal within the accelerating structure 4.

What we claim is:

1. A magnetic mirror for reflecting a beam of charged particles along its mean incident path of axis XX, said magnetic mirror which is designed to be associated with a linear particle accelerator comprising at least a first, a second and a third magnetic deflector, said first magnetic deflector being provided with two circular polepieces having a radius R and delimiting a circular air-gap, the center of which is located on said axis XX, a magnetic field $H_1$ of predetermined value being created within said circular air-gap; said second and third magnetic deflector being provided respectively with a pair of polepieces, the pair of polepieces of said second magnetic deflector and the pair of polepieces of said third magnetic deflector being identical and delimiting two air-gaps in which is created a magnetic field H having a direction opposite to that of magnetic field $H_1$, said pair of polepieces of said second magnetic deflector being arranged symmetrically on either side of said axis XX; said air-gaps of the polepieces of said second and third magnetic deflectors presenting respectively to the beam an entry face and an exit face, said entry face of said second magnetic deflector and said exit face of said third magnetic deflector being arranged about said circular air-gap of said first deflector, said exit face of said second magnetic deflector being defined in such a way that the different paths of the particles, the lengths of which depend on the momentum of said particles, emerge from said exit face of said second magnetic deflector normal to said axis XX.

2. A magnetic mirror as claimed in claim 1, wherein said polepieces of said second magnetic deflector and said polepieces of said third magnetic deflector have entry faces, and exit faces defined along two orthogonal axex OX and OY, O being the center of said circular air-gap and OX coinciding with said axis of symmetry XX of said magnetic mirror, by the following parametric equations:

$$X_{E2} = X_{S3} = (R+d)\cos\theta \quad (2)$$

$$Y_{E2} = -Y_{S3} = (R+d)\sin\theta \quad (3)$$

$$X_{S2} = X_{E3} = (R+d)\cos\theta + r\sin\theta + r \quad (4)$$

$$Y_{S2} = -Y_{E3} = (R+d)\sin\theta - r\cos\theta \quad (5)$$

d being the distance travelled by the particles between said first magnetic deflector and said second magnetic deflector and between said third magnetic deflector and said first magnetic deflector; said angle $\theta$, which is a function of the momentum of the particles and of the magnetic field value $H_1$, being the angle of the tangents to said paths of particles emerging from said first magnetic deflector with the axis XX coinciding with the mean path of an incident beam, radius of curvature, $\rho$, of the paths in the air-gap of said first magnetic deflector having a radius of curvature related to said angle $\theta$ as follows:

$$\rho = \frac{R\sin\theta}{1-\cos\theta} \quad (1)$$

r, which is a function of the momentum W and of the value of the magnetic field H in the second and third magnetic deflectors being the radius of curvature of said particle paths in said air-gaps of said second and third magnetic deflectors.

3. A magnetic mirror as claimed in claim 2, wherein before said magnetic mirror is placed on the path of the beam F, a convergent lens.

4. A magnetic mirror as claimed in claim 1, wherein said polepieces of said second magnetic deflector and polepieces of said third magnetic deflector have entry faces and exit faces defined along two orthogonal axes OX and OY, O being the centre of said air-gap of said first magnetic deflector and OX coinciding with said axis of symmetry XX of said magnetic mirror by the following parametric equations:

$$X_{E2}=X_{S3}=(R+d)\cos\theta \quad (2)$$

$$Y_{E2}=-Y_{S3}=(R+d)\sin\theta \quad (3)$$

$$X_{S2}=X_{E3}=(R+d)\cos\theta+r\sin\theta+r \quad (4)$$

$$Y_{S2}=-Y_{E3}=(R+d)\sin\theta-r\cos\theta \quad (5)$$

d being the distance separating said first magnetic deflector from entry face of said second deflector and from exit face of said third deflector; said angle $\theta$, which is a function of the momentum W of said particles and of the magnetic field $H_1$, being also angle of the tangents to the paths of the particles emerging from said first magnetic deflector with said axis XX coinciding with the mean path of said incident beam, radius of curvature $\rho$ of said paths in said air-gap of the first magnetic deflector being related to the angle $\theta$ as follows:

$$\rho=\frac{R\cos\theta}{1-\cos\theta} \quad (3)$$

and r, which is a function of the momentum W and of the magnetic field value H in the second and third magnetic deflector being said radius of curvature of said paths in said air-gaps of said second and third magnetic deflectors; verticals to the faces $E_{20}$ and $S_{30}$ form, with the incident paths and the corresponding emerging paths, angles of $\alpha=f(\theta)$, and in that, for a given path, the angles $\alpha$, $\beta$ and $\theta$ are related as follows:

$$\left|\frac{1}{tg\alpha}\right|=\frac{1}{tg\beta}+\theta+\pi/2.$$

$\alpha$ being the angle formed by the paths and the verticals to face $E_{20}$ and $S_{30}$ $\beta$ being the angle formed by the paths and the verticals to faces $S_{20}$ and $E_{30}$.

5. A magnetic mirror as claimed in claims 1, 4, wherein said magnetic field H of said second and third magnetic deflectors is equal to $-k\ H_1$, k being a numeric coefficient of predetermined values.

6. A magnetic mirror according to claim 5, wherein $k=1$.

7. A magnetic mirror as claimed in claim 2, wherein d is equal to a constant.

8. A magnetic mirror as claimed in claim 4, wherein d has a variable value which is a function of $\theta$.

9. A magnetic mirror as claimed in claim 8, wherein d is related to said angle $\theta$ as follows:

$$d=2\rho\cot g\ \theta.$$

10. A magnetic mirror as claimed in claim 1, wherein said parameters R, d, $\theta$ must satisfy to the inequality:

$$0<\cos\theta<\frac{R+d}{2R+d} \quad (7)$$

11. A magnetic mirror as claimed in claim 1, said magnetic mirror being located at one end of a linear charged particle accelerator.

* * * * *